US006168282B1

(12) United States Patent
Chien

(10) Patent No.: US 6,168,282 B1
(45) Date of Patent: Jan. 2, 2001

(54) ELECTRO-LUMINESCENT LIGHTING ARRANGEMENT FOR A LIGHTING APPARATUS WITH A LAMP HOLDER

(76) Inventor: Tseng-Lu Chien, 8F, No. 29, Alley 73, Lin-Shen Road, Shi-Chi Town, Taipei Hseng (TW)

( * ) Notice: Under 35 U.S.C. 154(b), the term of this patent shall be extended for 0 days.

(21) Appl. No.: 08/959,463

(22) Filed: Oct. 28, 1997

(51) Int. Cl.[7] ..... F21V 9/16

(52) U.S. Cl. ..... 362/84; 362/251; 362/229; 362/228; 362/806

(58) Field of Search ..... 362/84, 184, 253, 362/806, 249, 251, 228, 229, 276, 802, 147

(56) References Cited

U.S. PATENT DOCUMENTS 3,344,269 * 9/1967 Brown ..... 362/84
5,469,342 11/1995 Chien .
5,572,817 11/1996 Chien .
5,572,819 * 11/1996 Topinka et al. ..... 362/84
5,599,088 2/1997 Chien .
5,601,358 2/1997 Chien .
5,662,408 9/1997 Marischen .
5,667,394 9/1997 Chien .
5,667,736 9/1997 Chien .
5,683,164 11/1997 Chien .
5,704,705 1/1998 Chien .

* cited by examiner

*Primary Examiner*—Thomas M. Sember

(57) ABSTRACT

A conventional light socket, lamp holder, or lamp includes an additional illumination arrangement in the form of electro-luminescent elements connected to the lamp holder power supply. The electro-luminescent elements may be directly connected to the power supply or be included as part of an adapter unit which can be inserted into an existing lamp holder.

20 Claims, 4 Drawing Sheets

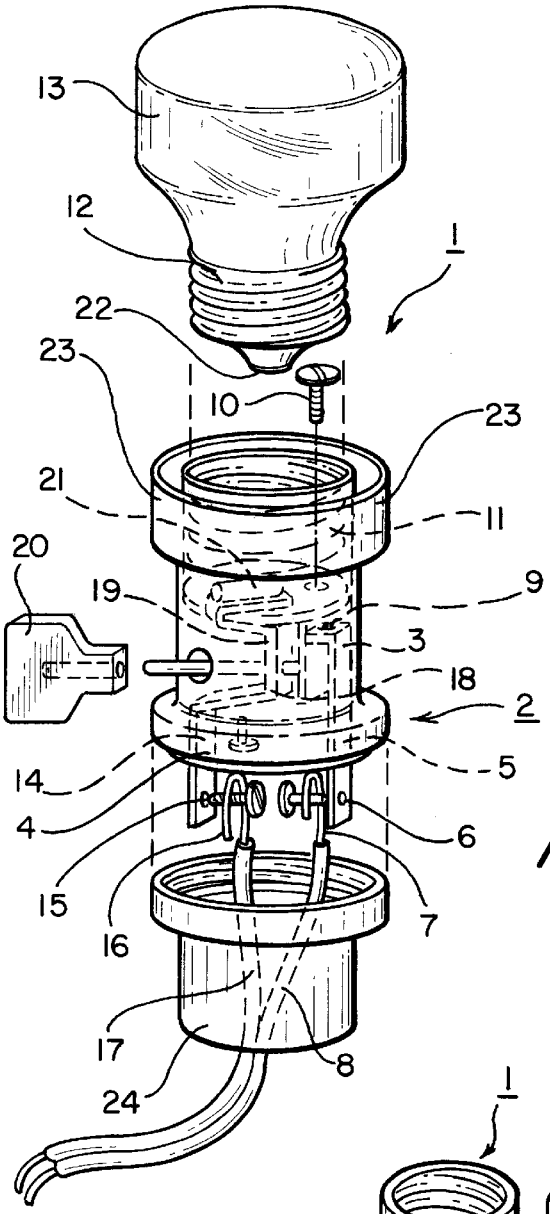
FIG. 1
(PRIOR ART)
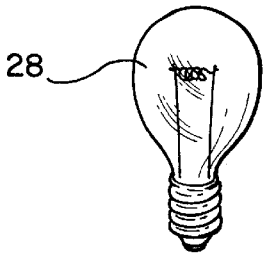
FIG. 3A
(PRIOR ART)
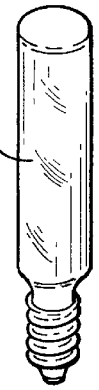
FIG. 3B
(PRIOR ART)
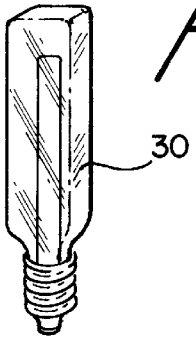
FIG. 3C
(PRIOR ART)
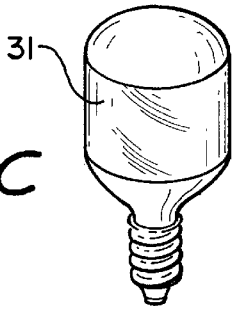
FIG. 3D
(PRIOR ART)
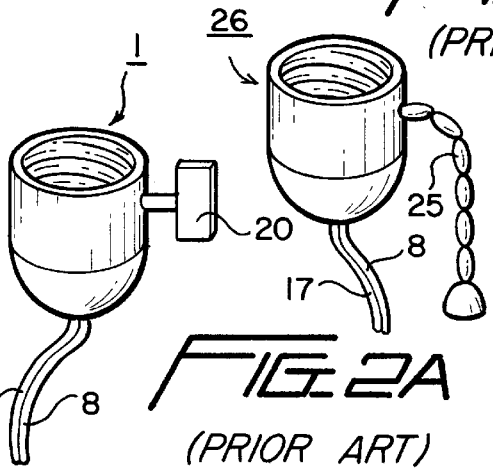
FIG. 2A
(PRIOR ART)
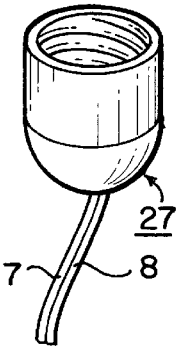
FIG. 2B
(PRIOR ART)
FIG. 2C
(PRIOR ART)

ELECTRO-LUMINESCENT LIGHTING ARRANGEMENT FOR A LIGHTING APPARATUS WITH A LAMP HOLDER

BACKGROUND OF THE INVENTION

1. Field of the Invention

This invention relates to a lighting apparatus of the type which includes a light socket or lamp holder, and in particular to a lighting apparatus which includes illumination elements in addition to the lighting element with which the light socket or lamp holder is normally used. The additional illumination elements are electro-luminescent panels, strips, or fibers, and may either be built-in to the lighting apparatus or provided as an adapter kit for a lighting apparatus.

2. Discussion of Related Art

Electro-luminescent lighting arrangements have been proposed for use in a variety of specific contexts, including illumination of footwear, headwear, backpacks, safety guides, moving objects, flying objects, containers, timepieces, and audio equipment, because of their flexibility and low power consumption, and their relative brightness, color choice, and wide viewing angle in comparison with other low power consumption devices such as LEDs.

The characteristic of low power consumption is particularly useful in the context of night lights. While the quality of light emitted by an electro-luminescent element is not well adapted for general illumination purposes, it is ideal for providing background illumination. Examples of night lights utilizing electro-luminescent elements are found in U.S. Pat. No. 5,662,408 and copending U.S. patent application Ser. No. 08/910,202, filed Aug. 13, 1997.

The purpose of such night lights is to provide low intensity illumination sufficient to enable a person to distinguish objects so as to be able to move about in a room or find items such as glasses, a refrigerator door, a light switch, or the snooze button on an alarm clock, or to comfort young children, while permitting sleeping and minimizing power consumption. Because of the quality of light emitted by electro-luminescent elements, their negligible power consumption in comparison with incandescent lights, their relative thinness and flexibility, wide viewing angle and color selection, and their ability to be cut into a variety of shapes, character, indicia, and logos, electro-luminescent elements offer significant advantages over incandescent lights for such purposes.

The problem addressed by the present invention is that the location at which conventional night lights can be placed is limited by their design. It is conventional to design night lights with prongs that can be plugged directly into a standard outlet, thereby providing a convenient design at minimal cost. As a result, however, the night lights can only be installed at the location of the outlet. This location is often not the best location for illumination purposes, or may be better utilized for a general purpose lighting fixture and not available for a night light without some sort of multiple outlet adapter. If the location of the night light is to be varied, then it is necessary to add an electric cord and mounting elements, which increases the cost of the night light and is unacceptable in the marketplace.

This problem is addressed in the present invention by adding electro-luminescent elements to a conventional light socket in order to eliminate the need for a separate night light housing and wiring, thereby freeing an electric socket while placing the light in a location where its effect can best be utilized.

An example of a conventional light socket 1 is shown in FIG. 1. It includes a contact, switch, and termination assembly 2 which includes a pair of contacts 3 and 4. Contact 3 includes a vertically extending portion 5, the lower end of which is provided with a screw terminal 6 for connecting the conductor 7 of a wire 8, and a horizontal upper end 9 which is connected by a screw 10 to an internally threaded contact 11 into which the base portion 12 of a light bulb 13 is screwed. Contact 4 also has a vertically extending portion 14 provided with a screw terminal 15 for connecting the conductor 16 of a wire 17, and a horizontal upper portion 18 arranged to engage a switch contact 19 when the switch handle 20 is turned to an "on" position, at which time the switch contact 19 is also arranged to engage a contact 21 positioned within the cylindrical internally threaded contact 11 but insulated therefrom, so as to complete the electrical circuit which supplies power to the light when the light bulb 13 is threaded into contact 11 by engaging a center contact 22 in base 12 of the light bulb. The light socket is completed by a cylindrical housing member 23 surrounding the contact, switch, and termination assembly 2 and a base member 24 through which wires 8 and 16 are passed and which is secured to the housing member 23 following termination of wires 8 and 16 to terminals 6 and 15.

Lighting apparatus having socket sets of the illustrated type can be in the form of table or desk lamps, wall or ceiling fixtures, chandeliers, garden or outdoor lighting, track lights, and so forth, and can come in a variety of configurations other than the illustrated configuration, include screw or wedge type, pin or bayonet type, insert, snap, and plug-in arrangements, for accommodating different types of lighting elements, such as incandescent light bulbs, gas-filled tubes or bulbs, fluorescent lights, PL lighting elements, HID lighting elements, mercury vapor lamps, phosphor coated lighting elements, and halogen lighting elements. For example, instead of the rotatable switch handle 20 shown in FIG. 1, and also in FIG. 2B, a pull chain 25 may be included, as in the socket 26 of FIG. 2A, or the switch may be eliminated in a favor of a switch elsewhere in the power supply, as in the socket 27 of FIG. 2C. Different light bulbs 28–31 which may be used with any of the sockets illustrated in FIGS. 2A–2C are shown in FIGS. 3A–3D, though numerous other bulb configurations are known.

Thus, the invention involves the combination of two known elements, namely an electro-luminescent lighting arrangement and a conventional lighting apparatus which includes a light socket. Furthermore, it turns out that modification of the lighting apparatus to accommodate an electro-luminescent lighting arrangement can be accomplished in a simple fashion, as will be described below, thereby lowering the cost involved in providing the items separately. Nevertheless, despite the simplicity of the combination proposed by the present invention, because night lights are generally used only when the lighting elements in conventional lighting apparatus of the illustrated type are turned off, night lights and conventional lighting apparatus have heretofore been considered to be separate and mutually exclusive items, with related but different purposes, and no one has proposed or attempted to combine the two different types of lights.

SUMMARY OF THE INVENTION

It is accordingly an objective of the invention to provide an electro-luminescent lighting arrangement which can serve as a night light but which can be placed at locations other than at the location of an electrical outlet without the need for complex wiring or a separate housing arrangement.

It is a further objective of the invention to provide a lighting apparatus which includes a light socket and that can also serve as a night light without unduly increasing the cost or complexity of the electrical connection, presenting safety hazards, or significantly increasing power consumption.

It is a further objective of the invention to combine a lighting apparatus including a light socket and electro-luminescent element in a way which simplifies assembly, minimizes costs, and yet does not increase the risk of short circuits or electric shocks.

It is yet another objective of the invention to provide a combined light socket and electro-luminescent lighting arrangement which provides a variety of decorative lighting effects in addition to general purpose lighting, including decorative lighting shapes and lighting effects such as flashing, chasing, etc., at minimal cost.

These objectives are achieved, in accordance with the principles of a first preferred embodiment of the invention by providing a lighting apparatus including a light socket and an additional illumination device in the form of an electro-luminescent element, and in accordance with the principles of a second preferred embodiment of the invention, by providing an adapter for adding an electro-luminescent element to an existing lighting apparatus. In each of the preferred embodiments of the invention, the electro-luminescent lighting element (or elements) is preferably connected between the power supply for the lighting apparatus and one of the socket contacts for the general purpose lighting element with which the light socket is designed to be used, either directly or via a circuit for controlling the electro-luminescent lighting element and/or adapting the power input to more efficiently trigger the electro-luminescent lighting element.

Examples of EL lighting elements which may be used with the combined lighting apparatus, socket, and electro-luminescent lighting arrangement of the present invention are the electro-luminescent panels disclosed in U.S. Pat. No. 5,572,817, and in copending U.S. patent application Ser. Nos. 08/729,408 (allowed), 08/734,872 (pending), and 08/746,706 (pending), each of which is incorporated by reference herein, as well as the three-dimensional electro-luminescent tube arrangement disclosed in U.S. patent application Ser. No. 08/758,393, which is also incorporated by reference herein. The combined conventional light socket and electro-luminescent lighting arrangement disclosed herein may also be used with the optical device disclosed in U.S. patent application Ser. No. 08/841,624 (pending), also incorporated herein by reference, which is a continuation of U.S. patent application Ser. No. 08/489,160 (abandoned), and may utilize such elements of prior electro-luminescent lighting arrangements as the connector described in U.S. patent application Ser. No. 08/383,404.

It will of course be understood that the present invention may be applied to any type of conventional lighting apparatus, and that details of the electrical connections and power circuitry may be varied in innumerable ways without departing from the scope of the invention.

BRIEF DESCRIPTION OF THE DRAWINGS

FIG. 1 is an exploded perspective view of a conventional light socket to which the principles of the present invention may be applied.

FIGS. 2A–2C are perspective views of various conventional light sockets similar to that shown in FIG. 1.

FIGS. 3A–3D are perspective views of various light bulbs suitable for use with the light sockets of FIGS. 2A–2C.

DETAILED DESCRIPTION OF THE PREFERRED EMBODIMENTS

Figure 13:
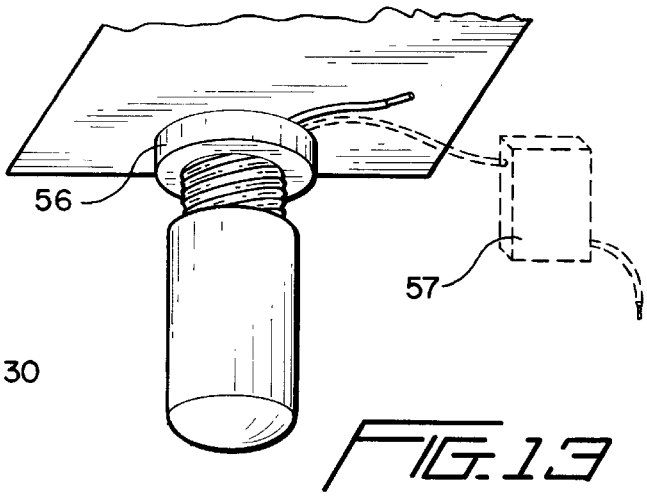
FIGS. 7–16 are perspective views showing variations of the combined conventional lights socket and electro-luminescent lighting arrangements of the first and second preferred embodiments of the invention.
Figure 4:
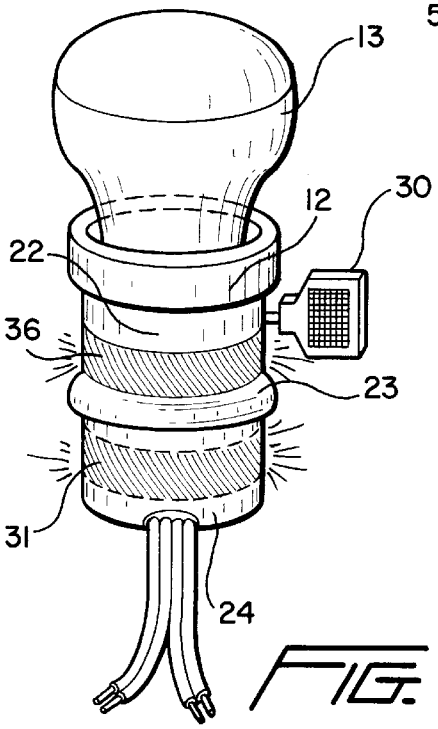
FIG. 4 is a perspective view of a combined light socket and electro-luminescent lighting arrangement constructed according to the principles of a preferred embodiment of the invention.
Figure 14:
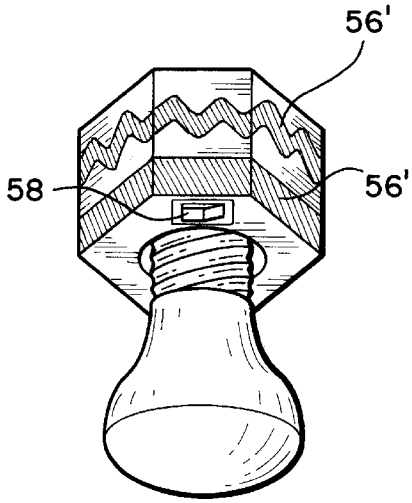

As illustrated in FIG. 4, a combined light socket and electro-luminescent lighting arrangement constructed in accordance with the principles of a preferred embodiment of the invention includes a light socket or fixture of the type illustrated in FIG. 1, including switch handle 20, cylindrical housing member 23, and base member 24, with internal connections of the type shown in FIG. 1 for supplying power from wires 7 and 16 to contacts arranged to engage light bulb 13 (or any other suitable light bulb which can be fitted into the socket).

Arranged on either of the housing members, or at any other location on the light socket or the lamp in which the light socket is housed, are electro-luminescent lighting elements 30 and 31. If the housing members 23 and 24 include transparent portions, the electro-luminescent elements may be mounted within the housing members, or the electro-luminescent elements may be mounted on the exterior of the housing members.

As indicated above, electro-luminescent lighting elements 30 and 31 can take a variety of forms, including an electro-luminescent panel of the type disclosed in U.S. Pat. No. 5,572,817 and copending U.S. patent application Ser. Nos. 08/729,408, 08/734,872, and 08/746,706, in which attractive designs are obtained by including logos, figures, cartoon characters, words, on either a frontsheet (not shown) or the electro-luminescent element itself, either by printing, silk-screening, stencilling, or the like, and/or by appropriately arranging the phosphor segments of the electro-luminescent element. Alternatively, or in addition to an electro-luminescent panel, electro-luminescent lighting elements 30 and 31 may include a three-dimensional tube arranged in an attractive pattern in the manner described in copending U.S. patent application Ser. No. 08/758,393.

Figure 5:
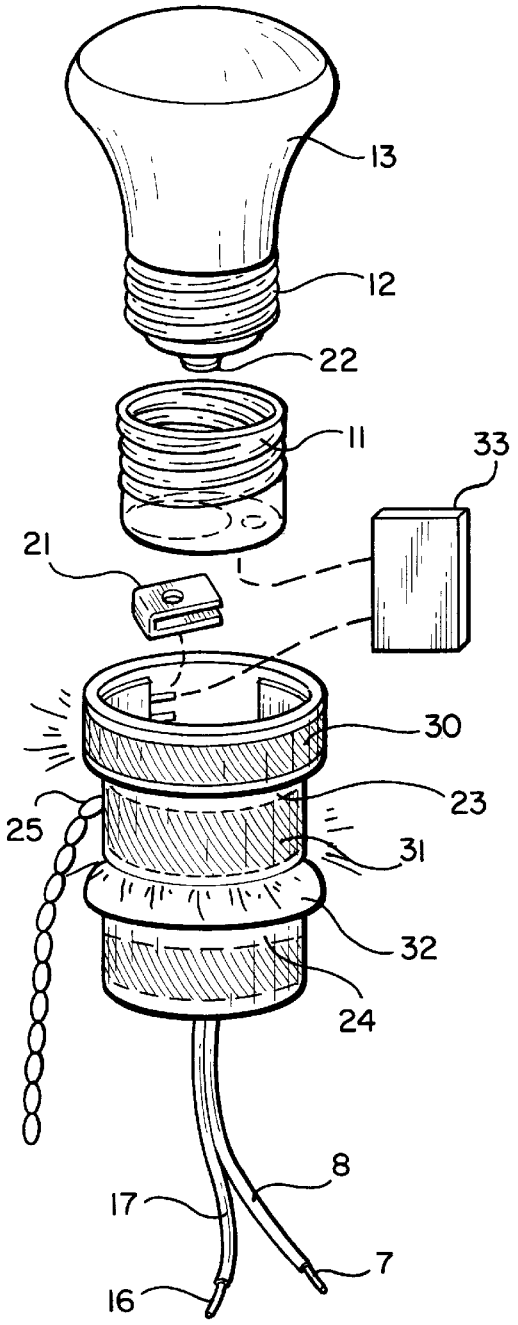
FIG. 5 is an exploded perspective view of a variation of the night light of FIG. 4, showing the manner in which the electro-luminescent lighting arrangement is wired into the light socket power circuit.

As shown in FIG. 5, which shows a pull chain type light socket similar to the one shown in FIG. 2A, but which may also be a light socket of the type shown in FIGS. 1 and 2B, or any other type of conventional light socket, the electro-luminescent elements 30–32 may be directly connected to the power supply, by connecting the terminals of the electro-luminescent to wires 7 and 16, so that the electro-luminescent element is always on, in series with one of the contacts 11 and 21, so that the electro-luminescent element is switched in the same manner as the main light, connected to a terminal of the switch such that when the main light is turned on, the electro-luminescent element is turned off, or connected in parallel with contacts 11 and 21 to a controller or switch circuit 33 for supplying power to the main light 13 and the electro-luminescent elements separately or together as desired.

Switch circuit or controller 33, which those skilled in the art will appreciate is optional, may be used to connect one or more electrodes of one or more electro-luminescent elements to an inverter, control circuit, function interface, or the like, examples of which are described in the above-cited copending applications, and can be in the form of a conventional circuit or an integrated circuit. Numerous suitable circuits are known and it is intended that the invention encompass any circuitry to which the electro-luminescent element might be connected, or no circuitry at all, with the electrodes of the electro-luminescent element being directly and exclusively connected to the prongs of the night light.

By circuitry is meant any electrical component, including wires, resistors, capacitors, transistors, inductors, and so forth, as well as switches of various types, including motion sensors connected to allow the electro-luminescent lighting element or elements to turn on while the light is off in response to motion of persons in the area of the light, a photosensor which turns on the electro-luminescent lighting elements but not light bulb 13 when the ambient light level is low, a timing device for turning on the electro-luminescent lighting element or the light bulb at predetermined times, an inverter for increasing the efficiency and brightness of the electro-luminescent lighting element by increasing the frequency and amplitude of the current supplied to the electro-luminescent lighting element, a dimmer switch for controlling the frequency and current supplied to the electro-luminescent lighting element in order to control its brightness, flasher or control circuits for causing multiple electro-luminescent lighting elements to exhibit special lighting effects such as chasing, random flashing, common flashing, steady on, fade/in fade/out, pair flashing, sequential flashing, or combination of such effects In addition, a back-up battery and circuit can be included to cause the electro-luminescent elements to light during a power failure.

While details of each of the above-mentioned types of circuits or switches are not shown, it will be appreciated by those skilled in the art that all of the above types of circuits and switches are known, and can be added to the light fixture by simply connecting them to the appropriate terminals of the electro-luminescent lighting element and power supply contacts or wires.

Figure 6:
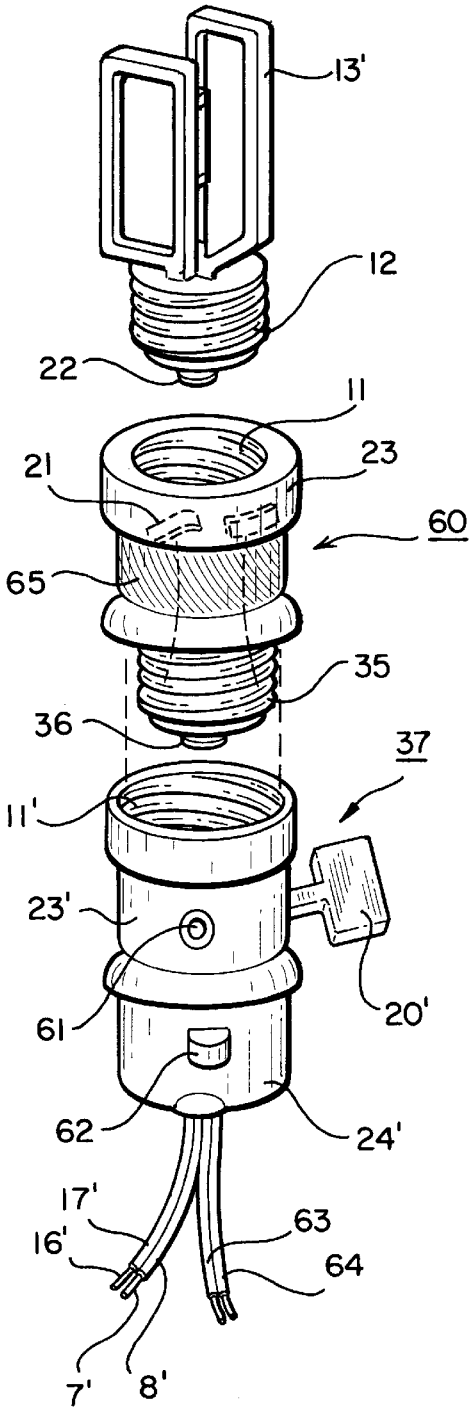
FIG. 6 is an exploded perspective view of an alternative preferred embodiment of the invention in which the electro-luminescent lighting arrangement is added to the conventional light socket by means of an add-on adapter kit.

In the embodiment shown in FIG. 6, instead of directly wiring the electro-luminescent element 34 and optional switch means 33 into the light socket during assembly of the light socket, the electro-luminescent element can be included in an adapter unit 60 identical to the light socket of FIG. 5, but in which wires 7 and 16 are replaced by a threaded outer contact 35 and a center contact 36 so that the unit can be threaded into an existing light socket 37 corresponding, for example, to the conventional light socket illustrated in FIG. 1. For convenience, the corresponding elements of the existing socket 37 shown in FIG. 6 are designated by primed reference numerals, with the existing socket further including a photosensor 61 and a motion sensor 62, and an additional set of wires 63 and 64 which has been added to provide for connection to additional electro-luminescent lighting elements which may be mounted elsewhere on a lamp in which the socket is placed. The electro-luminescent lighting element on the adapter 60 is designated as element 65 and the light bulb, which has a different configuration than the one shown in FIG. 5, as element 13'.

FIGS. 7–16 illustrate, by way of example, different implementations of the principles of the preferred embodiments, although those skilled in the art will appreciate that these examples are just a few of the numerous ways in which the different elements of the invention can be arranged within the scope of the invention.

Figure 7:
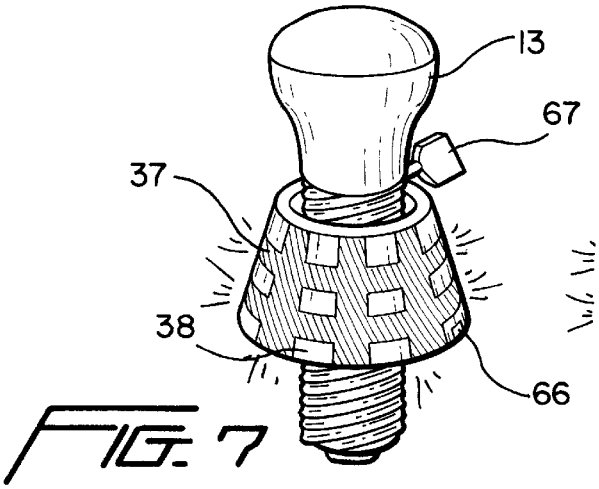
Figure 8:
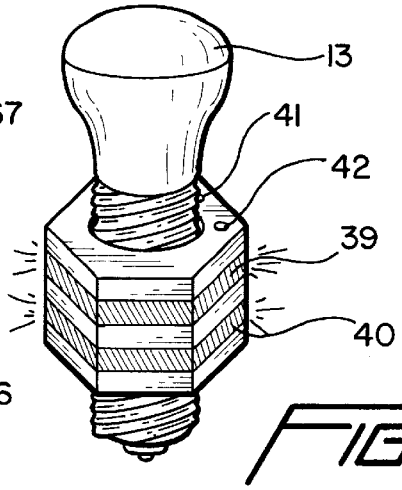

For example, in the version of the second preferred embodiment illustrated in FIG. 7, which is in the form of an add-on kit, the electro-luminescent lighting arrangement includes two different color lighting elements 37 and 38, a motion sensor 66 for the electro-luminescent light and/or the main light, and a multiple level dimmer switch 69 for the electro-luminescent light and/or the main light, while a similar two-color arrangement with electro-luminescent elements 39 and 40, a dimmer switch 41 and a motion sensor 42 is shown in FIG. 8.

Figure 9:
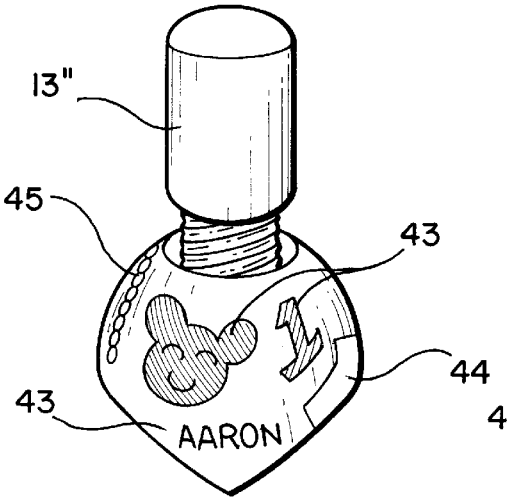
Figure 10:
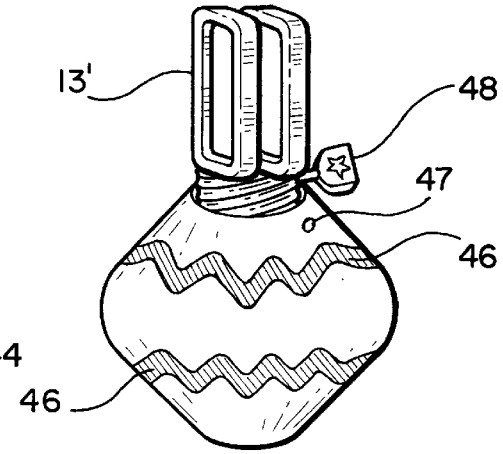

On the other hand, FIG. 9 shows an arrangement in which the light socket is included in a lamp for a bulb 13", and the electro-luminescent elements 43, which are in the form of designs, characters, logos, or other messages or indicia, are placed on the exterior or behind windows or openings in the lamp rather than on a housing of the socket itself. The electrical connections for this version of the preferred embodiments are the same as for the versions in which the electro-luminescent elements are placed more directly on the socket housing, but wires of extended length need to be run from the socket terminals to the electro-luminescent elements. This version includes a motion sensor 44, a pull-chain light switch 45, and of course may include other circuitry or switching elements such as a timer. The electro-luminescent elements could also, depending on the design of the lamp, be placed on a base of the lamp, a lamp cover, post, or holder, or at any other convenient location on the lamp. The version shown in FIG. 10 is similar, but with different designs for the electro-luminescent elements 46, a photosensor 47, and a light switch 48.

Figure 11:
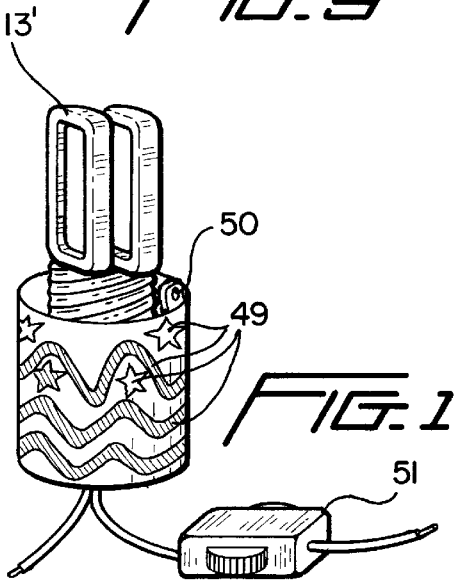
Figure 12:
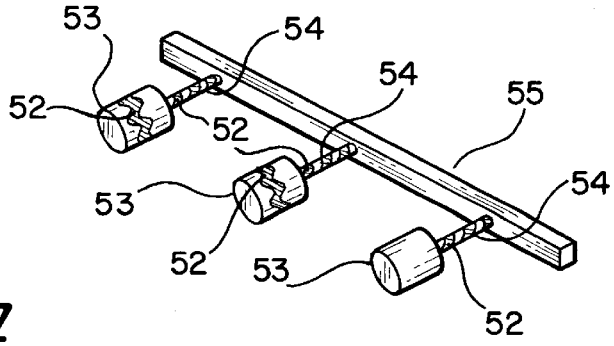

Additional designs for lighting elements 49 are shown in FIG. 11, which includes a photosensor 50 and an external switch 51, while FIG. 12 shows application of the invention to a track lighting system, including electro-luminescent elements 52 mounted both on the main lamps 53 and on the posts 54 which connect the main lights to a track 55.

Figure 15:
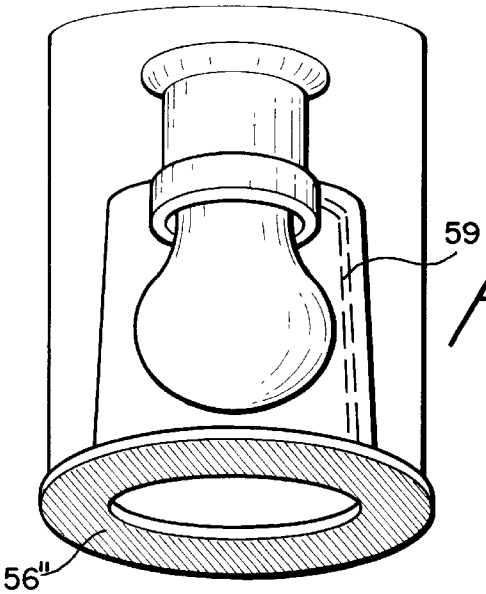
Figure 16:
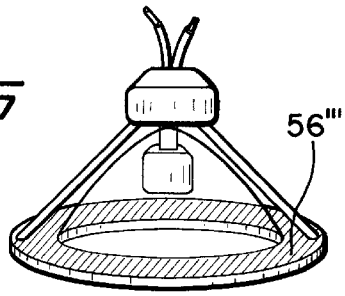

Finally, FIGS. 13–16 show applications in which the electro-luminescent elements are connected to a ceiling mounted lighting fixture, including respective electro-luminescent elements 56, 56', 56", 56''', the fixtures of these variations including features corresponding to features of the variations illustrated in FIG. 7–12, such as an external switch 57, or motion sensor 58, and wires 59 for connecting the electro-luminescent elements to the terminals in the socket, the electro-luminescent elements necessarily being placed flush or below the level of the ceiling even when the socket is recessed as in FIGS. 15 and 16.

Having thus described preferred embodiments of the invention and a number of different variations and modifications of the preferred embodiment, it is anticipated that still further variations and modifications will undoubtedly occur to those skilled in the art upon reading the above description, and it is therefore intended that the invention be interpreted solely in accordance with the appended claims.

I claim:

1. Illumination apparatus comprising:

a lighting apparatus including a lamp holder and a lighting element;

conductive means within said lamp holder for supplying electricity to the lighting element from an external power source;

at least one electro-luminescent element, said electro-luminescent element being in addition to said lighting element and electrically connected to said lamp holder; and conductive means for electrically connecting the electro-luminescent element to said power supply means.

2. Apparatus as claimed in claim 1, wherein said lamp holder is of a type selected from the group consisting of the following types: screw-in, wedge type, insert type, plug-in, snap-in, pin, and bayonet.

3. Apparatus as claimed in claim 1, wherein said conductive means comprises a means selected from the group consisting of blades, wires, ribbons, screws, springs, rivets, terminals, and solder.

4. Apparatus as claimed in claim 1, wherein the lighting element is a lighting element selected from the group consisting of incandescent lighting elements, fluorescent lighting elements, PL lighting elements, HID lighting elements, Mercury vacuum lamps, gas-filled lamps, phosphor coated lighting elements, and Halogen lighting elements.

5. Apparatus as claimed in claim 1, further comprising means for causing the electro-luminescent lighting elements to turn on and off at predetermined times.

6. Apparatus as claimed in claim 1, further comprising a device selected from the group consisting of motion sensor, photosensor, PIR sensor, photo transistor, dimmer switch, vibration switch, thermal switch, acoustic switch, vibration switch, power fail detector, and manual switch for turning the electro-luminescent lighting element on and off.

7. Apparatus as claimed in claim 1, wherein the electro-luminescent lighting element is selected from the group consisting of panels, sheets, tubes, bars, strips, two-dimensional lighting elements, and three-dimensional lighting elements.

8. Apparatus as claimed in claim 1, wherein said conductive means further comprises inverter circuitry which forms a means for triggering the electro-luminescent element to exhibit a desired brightness and color.

9. Apparatus as claimed in claim 1, wherein said inverter circuitry further includes means for controlling display functions of the electro-luminescent lighting element, including illumination duration, motion effects, illumination cycles, and frequency of the cycles.

10. Apparatus as claimed in claim 1, wherein the electro-luminescent element is mounted on an element of the lighting apparatus selected from the group consisting of a lamp housing, lamp cover, lamp post, lamp stand, lamp casing, and decoration base.

11. Illumination apparatus comprising:

a lamp holder including receiving means for receiving a lighting element and adapter means for enabling the lamp holder to be received in and electrically connected to an existing lamp holder;

power supply means for supplying power to the lighting element from an external power source;

at least one electro-luminescent element, said electro-luminescent element being in addition to any lighting element, received in said lamp holder; and conductive means for electrically connecting the electro-luminescent element to said power supply means.

12. Apparatus as claimed in claim 11, wherein said lamp holder receiving means is of a type selected from the group consisting of the following types of receiving means: screw-in, wedge type, insert type, plug-in, snap-in, pin, and bayonet.

13. Apparatus as claimed in claim 11, wherein said conductive means comprises a means selected from the group consisting of blades, wires, ribbons, screws, springs, rivets, terminals, and solder.

14. Apparatus as claimed in claim 11, wherein the lighting element is a lighting element selected from the group consisting of incandescent lighting elements, fluorescent lighting elements, PL lighting elements, HID lighting elements, Mercury vacuum lamps, gas-filled lamps, phosphor coated lighting elements, and Halogen lighting elements.

15. Apparatus as claimed in claim 11, further comprising means for causing the electro-luminescent lighting elements to turn on and off at predetermined times.

16. Apparatus as claimed in claim 11, further comprising a device selected from the group consisting of motion sensor, photosensor, PIR sensor, photo transistor, dimmer switch, vibration switch, thermal switch, vibration switch, acoustic switch, power fail detector, and manual switch for turning the electro-luminescent lighting element on and off.

17. Apparatus as claimed in claim 11, wherein the electro-luminescent lighting element is selected from the group consisting of panels, sheets, tubes, bars, strips, two-dimensional lighting elements, and three-dimensional lighting elements.

18. Apparatus as claimed in claim 11, wherein said conductive means further comprises inverter circuitry which forms a means for triggering the electro-luminescent element to exhibit a desired brightness and color.

19. Apparatus as claimed in claim 11, wherein said inverter circuitry further includes means for controlling display functions of the electro-luminescent lighting element, including illumination duration, motion effects, illumination cycles, and frequency of the cycles.

20. Apparatus as claimed in claim 11, wherein the electro-luminescent element is mounted on an element of the lighting apparatus selected from the group consisting of a lamp housing, lamp cover, lamp post, lamp stand, lamp casing, and decoration base.

* * * * *